US007856833B2

(12) United States Patent
Young

(10) Patent No.: US 7,856,833 B2
(45) Date of Patent: Dec. 28, 2010

(54) COOL CAP FOR OUTDOOR HEAT EXCHANGERS

(76) Inventor: Gerald A. Young, 338 Westwood Dr., York, PA (US) 17404

( * ) Notice: Subject to any disclaimer, the term of this patent is extended or adjusted under 35 U.S.C. 154(b) by 0 days.

(21) Appl. No.: 12/423,246

(22) Filed: Apr. 14, 2009

(65) Prior Publication Data

US 2010/0126693 A1 May 27, 2010

Related U.S. Application Data

(60) Provisional application No. 61/199,748, filed on Nov. 21, 2008.

(51) Int. Cl.
*F25D 17/06* (2006.01)

(52) U.S. Cl. ..... 62/90; 62/259.1; 62/298

(58) Field of Classification Search ..... 62/90, 62/96, 259.1, 298, 186, 467, 262, 419, 515; 454/237, 358, 201; 165/42, 122, 201
See application file for complete search history.

(56) References Cited

U.S. PATENT DOCUMENTS 2,655,795 A * 10/1953 Dyer ..... 62/179
2,978,881 A * 4/1961 Alsing ..... 62/324.6
4,138,859 A * 2/1979 Pietsch ..... 62/324.3
4,204,409 A * 5/1980 Satama ..... 62/271
4,815,530 A * 3/1989 Scott ..... 165/134.1
4,918,943 A * 4/1990 Faust ..... 62/305
5,158,486 A * 10/1992 Tamame ..... 62/506
6,745,589 B2 * 6/2004 Katatani et al. ..... 62/259.1
6,912,766 B2 * 7/2005 Wendt et al. ..... 29/428

* cited by examiner

*Primary Examiner*—Mohammad M Ali
(74) *Attorney, Agent, or Firm*—Pepper Hamilton LLP

(57) ABSTRACT

A new apparatus, which may be referred to as a "cool cap," for use with an outdoor heat exchanger (e.g., a heat pump or an air conditioning condenser) having an air inlet vent and an air outlet vent, the apparatus comprising a top having an exhaust vent complementary to the air outlet vent; and a surrounding wall attached to the top, wherein the surrounding wall is at least about eight inches from the outdoor heat exchanger upon installation, and wherein the surrounding wall has an intake opening having an airflow being equal to or greater than the exhaust vent and forming a substantially unimpeded air pathway through the apparatus through the outdoor heat exchanger and out the exhaust vent; wherein the surrounding wall and top are thermally insulating.

20 Claims, 6 Drawing Sheets

COOL CAP FOR OUTDOOR HEAT EXCHANGERS

CROSS-REFERENCE TO RELATED APPLICATIONS

This application claims the priority of U.S. 61/199,748, filed on Nov. 21, 2008, the entire contents of which are incorporated herein reference.

FIELD

This application describes an enclosed apparatus for insulating and shading an outdoor heat exchanger (e.g., an air conditioner or heat pump condenser) from solar radiation, and related methods of use thereof.

BACKGROUND

In the refrigeration cycle, a mechanical device transfers heat from a lower-temperature heat source into a higher-temperature heat sink, whereas heat would naturally flow in the opposite direction. In this cycle, latent heat is released during a liquid to gas phase change. Typically an electric compressor motor is used to drive the refrigeration cycle in which a refrigerant is pumped into a cooled compartment (usually in the form of an evaporator coil), where low pressure causes the refrigerant to evaporate into a vapor, taking heat with it. In another compartment (usually in the form of a the condenser coil), the refrigerant vapor is compressed and forced through another heat exchange coil, condensing into a liquid, and rejecting the heat previously absorbed from the cooled space.

A "heat pump" is a term for a type of air conditioner in which the refrigeration cycle is able to be reversed, thereby producing heat instead of cold in the indoor environment. Using an air conditioner in this way to produce heat is significantly more efficient than electric resistance heating. Some home-owners elect to have a heat pump system installed, which is actually simply a central air conditioner with heat pump functionality (the refrigeration cycle is reversed in the winter). When the heat pump is enabled, the indoor evaporator coil switches roles and becomes the condenser coil, producing heat. The outdoor condenser unit also switches roles to serve as the evaporator, and produces cold air (colder than the ambient outdoor air).

Heat pumps are more popular in milder winter climates where the temperature is frequently in the range of 40-55° F. (4-13° C.), because heat pumps become inefficient below that temperature range. Air source heat pumps (as opposed to geothermal heat pumps) are relatively easy and inexpensive to install, and have therefore historically been the most widely used heat pump type.

However, air source heat pumps suffer limitations due to their use of the outside air as a heat source or sink. Indeed, outdoor condenser coils are ideally situated and installed in full direct sunlight so that the magnitude of the heat source is maximized during colder months. During winter, for example, daytime sunlight advantageously warms the outdoor condenser unit to thereby improve the heat pump's efficiency. Unfortunately, such conditions heat the condenser unit and thereby diminish performance during the summer months when the heat pump is working in cooling mode. Accordingly, a continuing and unmet need exists for new and improved means for improving the cooling performance of heat pumps during the summer.

SUMMARY

Provided herein are a new type of apparatus, which may be referred to as a "cool cap," for use with an outdoor heat exchanger (e.g., an air source heat pump or an air conditioning condenser) having an air inlet vent and an air outlet vent. A cool cap apparatus has a top with an exhaust vent complementary to the outdoor heat exchanger air outlet vent; and a surrounding wall attached to the top, wherein the surrounding wall is spaced from the outdoor heat exchanger upon installation, and wherein the surrounding wall has an intake opening having an airflow being equal to or greater than the exhaust vent and forms a desired substantially unimpeded air pathway through the apparatus through the outdoor heat exchanger and out the exhaust vent; wherein the surrounding wall and top are protective from solar radiation, as well as being thermally insulating.

The term "spaced" from the outdoor heat exchanger is meant to indicate an unimpeded air passageway between the heat exchanger and the surrounding wall, and it is not meant to exclude incidental contact by means of, for example, stabilizing attachments or mounting brackets that would not substantially impact air flow through the cool cap apparatus. An appropriate spacing distance will depend on the characteristics of the heat exchanger, including the velocity and volume of air that it processes, as well as the size of the unit. Typical spacing distances for common household heat pump units are between about eight inches and fifteen inches (e.g., eight inches), measuring horizontally from the side of the heat exchanger directly to the interior of the surrounding wall.

Also provided herein is a new method of increasing the performance of an outdoor heat exchanger (e.g., an air source heat pump or an air conditioning condenser) comprising steps of (1) providing an outdoor heat exchanger having an air inlet vent and an air outlet vent; (2) providing an apparatus comprising a top having an exhaust vent complementary to the air outlet vent; and a surrounding wall attached to the top, wherein the surrounding wall has an intake opening having an airflow being equal to or greater than the exhaust vent and forming a substantially unimpeded air pathway through the apparatus through the outdoor heat exchanger and out the exhaust vent; and (3) installing the apparatus over the outdoor heat exchanger so that the surrounding wall is spaced from the outdoor heat exchanger and the top contacts the outdoor heat exchanger. According to the foregoing method, the surrounding wall and top are thermally insulating, and the top and surrounding wall substantially shade the outdoor heat exchanger from direct sunlight.

Additional features may be understood by referring to the accompanying drawings, which should be read in conjunction with the following detailed description and examples.

DETAILED DESCRIPTION

Figure 1:
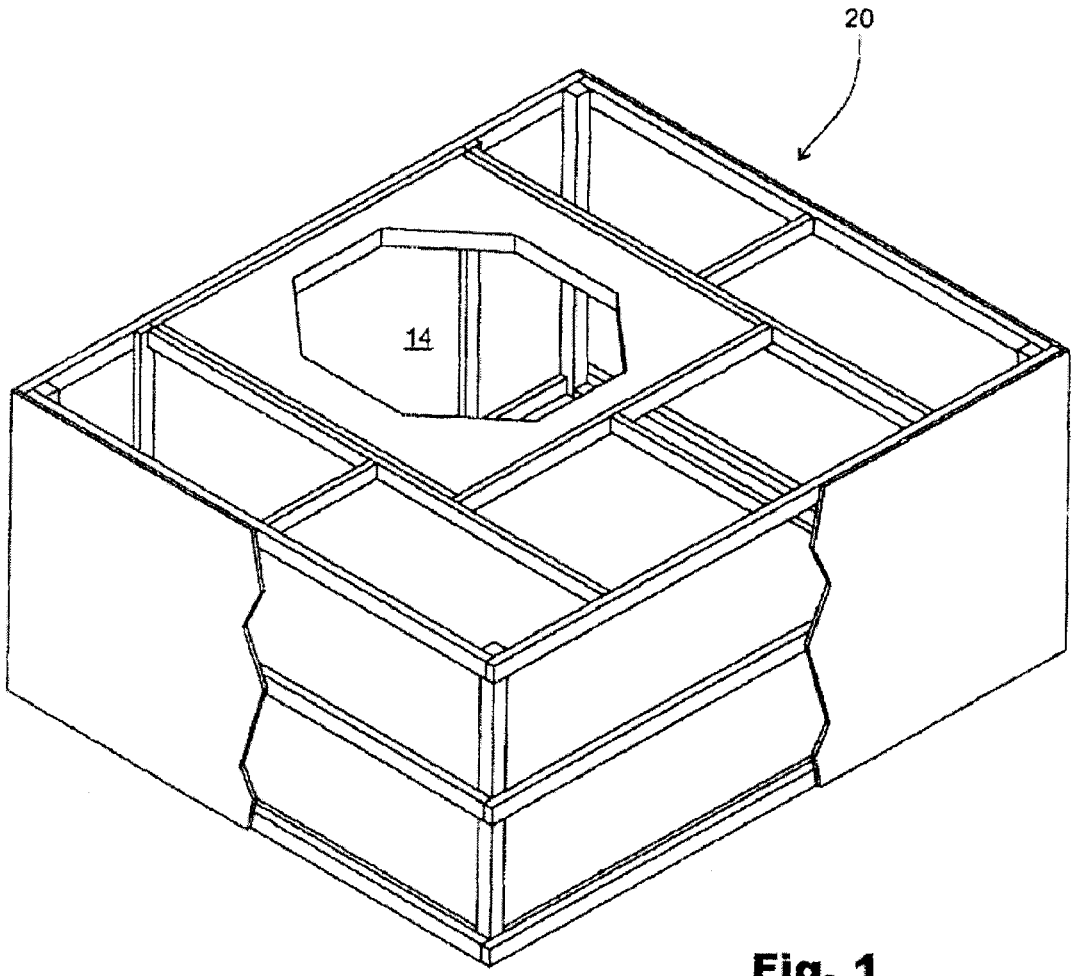
FIG. 1 illustrates a cut away view of an internal supporting framework of an example cool cap apparatus in accordance with an example embodiment hereof.
Figure 2:
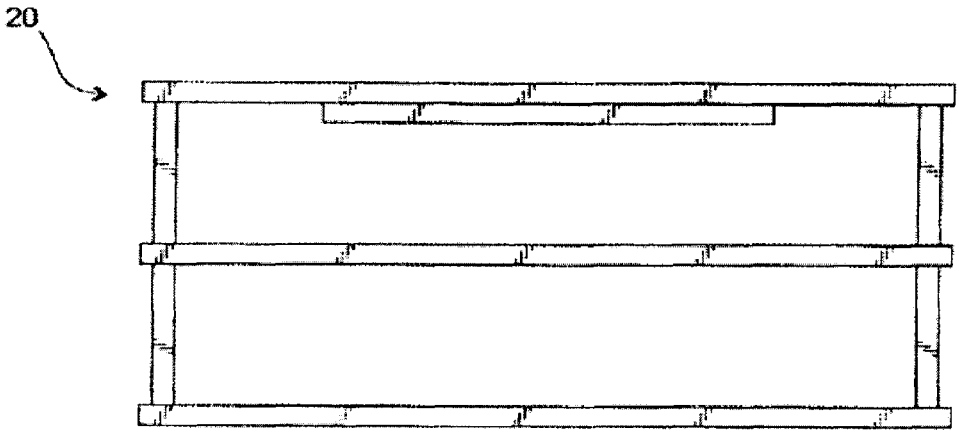
FIGS. 2 and 3 are front and rear views of an internal supporting framework of an example cool cap apparatus.
Figure 3:
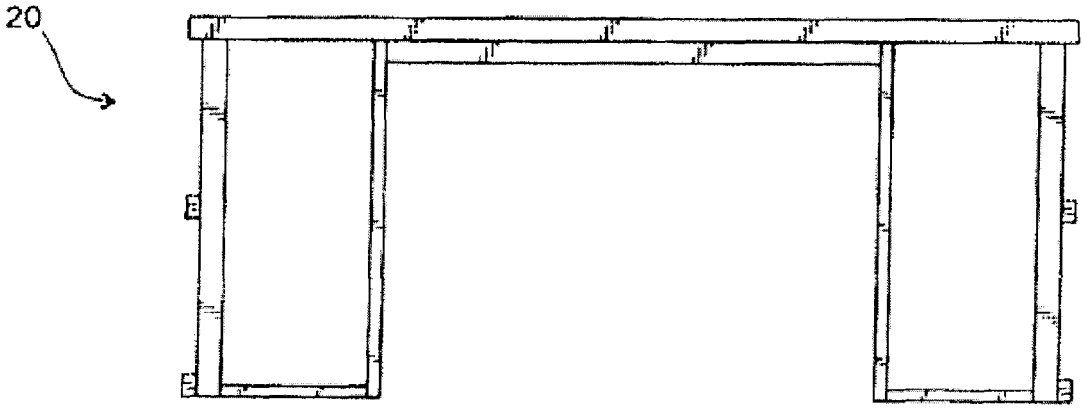
Figure 4:
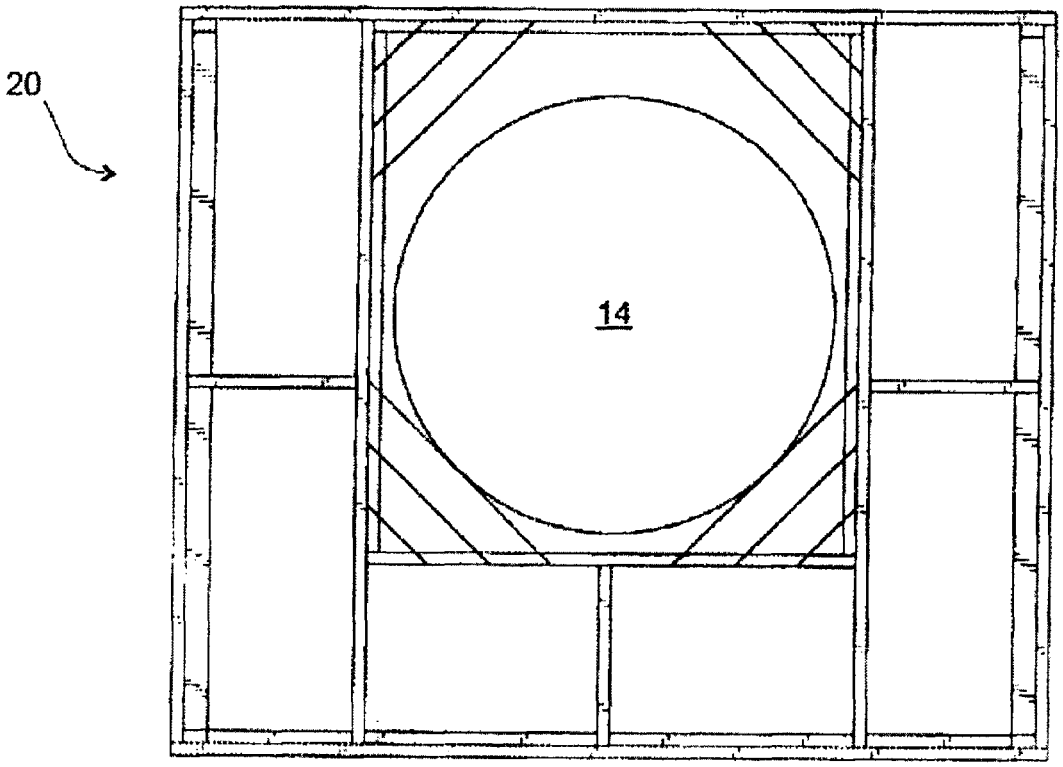
FIG. 4 is a top view of an internal supporting framework of an example cool cap apparatus.

This invention relates to a cool cap apparatus for use with an outdoor heat exchanger. A typical outdoor heat exchanger (e.g., an air source heat pump or an air conditioning condenser) has an air inlet vent and an air outlet vent through which air flows. This air flow exchanges heat between the heat exchanger and heat in the air. Among other advantages, a cool cap apparatus provides an improved air pathway through the outdoor heat exchanger and out the exhaust vent. It also provides shade to the heat exchanger when it is operating in direct sunlight.

In an example embodiment hereof, a cool cap apparatus includes a top having an exhaust vent complementary to the air outlet vent of the outdoor heat exchanger (the exhaust vent fitting tightly to the air outlet vent); and a surrounding wall attached to the top, wherein the surrounding wall is spaced (e.g., by about eight inches) from the outdoor heat exchanger upon installation, and wherein the surrounding wall has an intake opening having an airflow being equal to or greater than the exhaust vent and forming a substantially unimpeded air pathway through the apparatus through the outdoor heat exchanger and out the exhaust vent; wherein the surrounding wall and top are thermally insulating.

The surrounding wall of a cool cap apparatus should be sufficiently far from the heat exchanger (e.g., between about eight inches and about fifteen inches) during operation so that air flow into it is not substantially impeded and so that the blower or fan motor does not have to overcompensate for resistance to restricted airflow for which it was not designed. Furthermore, the intake opening in the surrounding wall should be large enough to supply sufficient air to the heat exchanger; if it is insufficiently large it may choke the outdoor heat exchanger.

A cool cap apparatus, therefore, functions as an outdoor ductwork that redirects air through an air pathway within the cool cap apparatus. In a particularly advantageous embodiment, the ductwork may be configured to draw cool air from a shaded area under an building (e.g., a cellar, basement, or crawlspace) to thereby improve the performance of the outdoor heat exchanger. Rather than drawing ambient air generally available in an exterior environment, cooler air may be purposefully directed to the heat exchanger, with a concomitant improvement in performance.

Furthermore, when an outdoor heat exchanger indiscriminately draws air from all directions, it often happens that its coils become blocked with debris, especially leaves. Contamination by debris may be substantially eliminated by using a cool cap in which the intake opening(s) of the surrounding wall has, for example, a screen, mesh, or filter to catch and exclude debris.

A further advantage of using a cool cap apparatus is that is protects an outdoor heat exchanger from the elements. For example, when not in operation, wind may cause the fan blades of an unprotected outdoor heat exchanger apparatus to rotate, thereby causing undesirable wear on its components. A cool cap apparatus shields an outdoor heat exchanger from such wind and hail damage.

Moreover, a cool cap apparatus may add to the aesthetic appeal of a property by concealing an unattractive outdoor heat exchanger. For example, external surfaces of a cool cap apparatus may be painted an inconspicuous color, or it may be painted a color to match that of nearby buildings, structures, or environment.

A cool cap apparatus can be constructed from a variety of materials, such as rigid foam, fiberglass, and the like. Beneficial materials used in construction of a cool cap apparatus are poor conductors of heat (i.e., thermal insulators), and so many uncoated metal components that would become heated in direct sunlight are not ideal. In an example cool cap apparatus, rigid foam boards are used to construct an external top and surrounding wall over an internal rigid supporting wooden framework to which the surrounding wall and the top are attached. Exterior surfaces of the walls and top are covered with one or more coats of light-colored or reflective material, such as a reflective paint (e.g., three coats of aluminum pitch or white paint). Further optional components may include vapor barriers, handles for facilitating installation and removal, or fastening means (latches, belts, bolts, etc.) to immobilize the cool cap apparatus after installation. Any materials used in the construction of a cool cap apparatus are preferably impermeable to air, water, and sunlight, and they are mutually compatible so as to prevent undesirable degradation by oxidation or rusting, for example.

In another embodiment hereof, a method of increasing the performance of an outdoor heat exchanger (e.g., air source heat pump or air conditioning condenser) includes steps of (1) providing an outdoor heat exchanger having an air inlet vent and an air outlet vent; (2) providing a cool cap apparatus comprising a top having an exhaust vent complementary to the air outlet vent; and a surrounding wall attached to the top, wherein the surrounding wall has an intake opening having an airflow being equal to or greater than the exhaust vent and forming a substantially unimpeded air pathway through the apparatus through the outdoor heat exchanger and out the exhaust vent; and (3) installing the apparatus over the outdoor heat exchanger so that the surrounding wall is spaced (e.g., between about eight inches and about fifteen inches) from the outdoor heat exchanger and the top contacts the outdoor heat exchanger; wherein the surrounding wall and top are thermally insulating, and the top and surrounding wall together substantially shade the outdoor heat exchanger from direct sunlight.

According to the foregoing method, the apparatus may be removable, it being installed over an air source heat pump when it is operating in cooling mode. Similarly, it may be installed prior to or during warm weather conditions (e.g. summer or spring). As noted above, a cool cap apparatus may be installed such that the air pathway is in fluid communication with an air source drawn from a shaded location at a temperature lower than ambient temperature, such as a basement, cellar, crawlspace under a building (e.g., a mobile home or modular office space), or a cave.

So that the invention may be better understood, reference is made to the following example, which should not be construed as limiting.

EXAMPLE

Referring to the attached drawings, FIGS. 1-9 depict example cool cap apparatus 10 as constructed by the inventor, who used the following constructions materials in making this embodiment:

| Qty | Description |
|---|---|
| 4 | 4" galvanized decking screws |
| 1 lb. | 2" galvanized decking screws |
| 1 box | 1½" roofing nails |
| 2 tubes | 10 oz. exterior Liquid Nails |
| 2 sheets | 4' × 8' × ¾" Dow insulation board |
| 1 roll | 3" × 50 yd. AF-982 FSK foil tape |
| 1 | standard 2" × 4" × 8' timber |
| 3 | pressure treated 2" × 4" × 8' timbers |
| 2 | 1" × 3" × 8' pine furring strips |
| 1 gal. | exterior grade latex paint |

The inventor used Liquid Nails in all screw holes and on all surfaces held together by screws attached to internal supporting framework 20. Holes were pre-drilled to prevent wood split.

The inventor measured the heat pump unit to be covered (not depicted), which was 30½" wide×33½" deep×26" high. Of course, all measurements should be modified to accommodate the target unit. An objective was to have approximately 12" clearance inside cool cap apparatus 10 for air flow around the unit coil. The rear of the unit was facing towards building 22 and was where the service access was located. This side was left open to conserve materials and because typically little to no sun shines on that location in this location. This also allowed for easy placement and removal of cool cap apparatus 10 as seasonal weather conditions change.

In order to assemble internal supporting framework 20, the inventor cut two lengths of 33¾", two lengths of 32¼", four lengths of 4⅞" and four lengths of 9⅞" of pine. The 4⅞" and 9⅞" pieces were measured on the longest side and cut on 45% angles to be used as bracing on each corner of the pine frame. These 45% boards serve to hold the whole frame up and rest on the unit.

The inventor assembled the pine frame used around the top of the unit using 1"×3" furring strips cut in the previous step. When completed, the inventor ensured that this pine frame fit snuggly on top of the target heat pump unit, and it was adjusted as necessary before continuing. The inside pine frame was painted using two coats exterior paint.

Next, the inventor cut pressure treated ("PT") 2"×4"×8' wood as follows. Board 1: he cut 25½" from which two 25½"×1½" pieces are cut; and cut 54½" from which four 54½"×1½"×¾" pieces are cut. Board 2: he cut 25½" from which two 25½"×1½" pieces are cut; cut 24" from which two 24"×1½"×¾" pieces are cut; and cut 45½" from which four 45½"×1½"×¾" pieces are cut. Board 3: he cut entire board into 1½"×¾" strips. Out of these strips, he cut the following: four 45½'×1½"×¾"; two 42½"×1½"×¾"; one 50"×1½"×¾"; one 10¼"×1½"×¾"; two 10½"×1½"×¾"; and two 9¼"×1½"×¾".

The inventor then laid the pine frame upside down on a flat work surface large enough to assemble the PT frame around the pine frame. All PT boards around the top of this pine frame were mounted flush against the work surface that the pine frame was laying on. For any screws that may have protruded, he take into consideration which direction they were inserted so that he was are able to cut off the protruding part with a hack saw.

Next, the inventor fastened one 54½" PT strip to rear of the pine frame, and he placed ½" surface flush to top of pine frame laying flat on same work surface. He ensured this board was centered resulted in approximately 12" sticking out on either end. He then clamped into place and used three 2" galvanized screws placed 1" in from each edge of pine frame and one near the center. Next, he attach one 10½" PT strip at 90% angle in the center of two 45½" PT strips to be used in the following step. He used one screw through each 45½" strip into each 10½" strip.

Then the inventor fastened one 45½" PT strip along each side of pine frame. He placed ½" surface flush to top of pine frame laying flat on same surface and butted against the 54½" PT previously attached with the previously attached 10½" strip facing away from the pine frame. He then clamp it into place and used two 2" galvanized screws placed 2" in from each end of pine frame to secure the pieces of wood.

Next, the inventor fastened one 54½" PT strip to the front of the pine frame. He placed ½" surface flush to top of the pine frame laying flat on same work surface. He ensured that this board was centered, which should result in approximately 12" sticking out on either end. He clamped into place and use two galvanized screws placed into the edge of the two 45½" PT strips, which were previously attached. He attached one 45½" PT strip on each side between the 54½" PT strips previously attached, and screwed into each end through the 54½" PT strips. He then screwed through each 45½" PT strip into each 10½" PT strip in the middle and attached the 10¼" strip in front between 54½" PT strip and pine frame. The inventor positioned in the center and used one screw in each end, one through pine and one through PT. Then he attached one 25½"×1½"×1½" PT strip to each outside corner of PT frame (inside each corner and flush to the flat work surface).

Next, the inventor attached one 24"×1½"×¾" PT strip to the rear on both sides of the pine frame (placement is on outside edge with 1½" side flush to back of pine frame and under the 45½" PT board). Then he attached one 45½" PT strip to both sides half way between the top and bottom (placement should measure 10" from top of PT frame and be flush to outside edge of each corner). He next attached one 45½" PT strip to both sides on the bottom of each side (placement should be flush to the end of each corner and flush to outside edge), and he attach one 54½" PT strip to the middle front and to the bottom front overlapping the corners and covering the outside 45½" PT strip. Continuing, he next attached one 9¼" PT strip between the bottom of each rear corner previously mounted and the bottom of the 24"×1½"×¾" PT strips, which were previously mounted. Then he attached one 42½" PT strip to the each side bottom 45½" PT strip on the inside for structural rigidity and to avoid bowing (placement is flush to bottom edge). He also attached the 50" PT strip inside the front bottom 54½" PT strip for stability and to avoid bowing (placement is flush to bottom edge). As illustrated in FIG. 1-7, internal supporting framework 20 for the apparatus was now complete.

Figure 8:
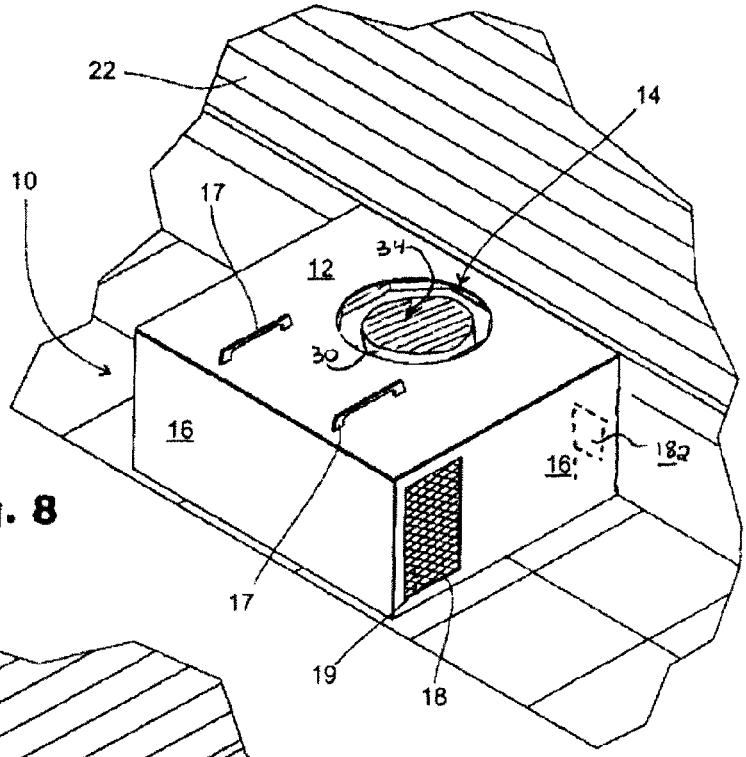
FIGS. 8 and 9 are left and right perspective views of an example cool cap apparatus that has been installed over an outdoor heat exchanger.
Figure 9:
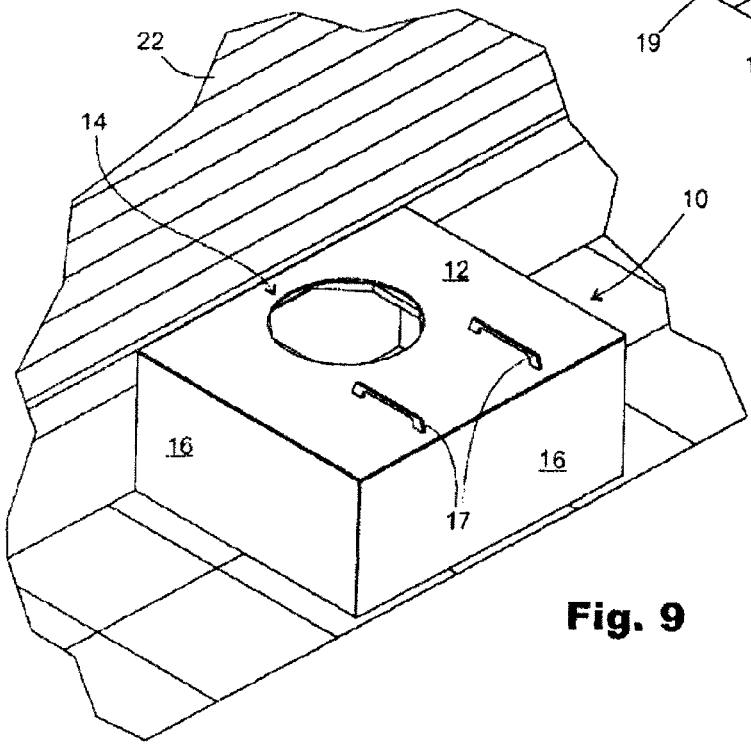

Next, referring to FIGS. 8 and 9, the inventor cut ¾" Dow brand insulation board (silver side out) to fit around the front and sides of the condenser unit, keeping in mind that the top piece will overlap the front and side pieces. He attached with Liquid Nails brand adhesive on the PT frame boards and 1½" roofing nails, which do not require pre-drilling. Then he cut ¾" Dow brand insulation board (silver side out) to fit on the top and overlapping the front and side pieces. After attaching this, he cut a round hole to allow the fan guard on the heat pump unit and out-bound air to come through.

Figure 5:
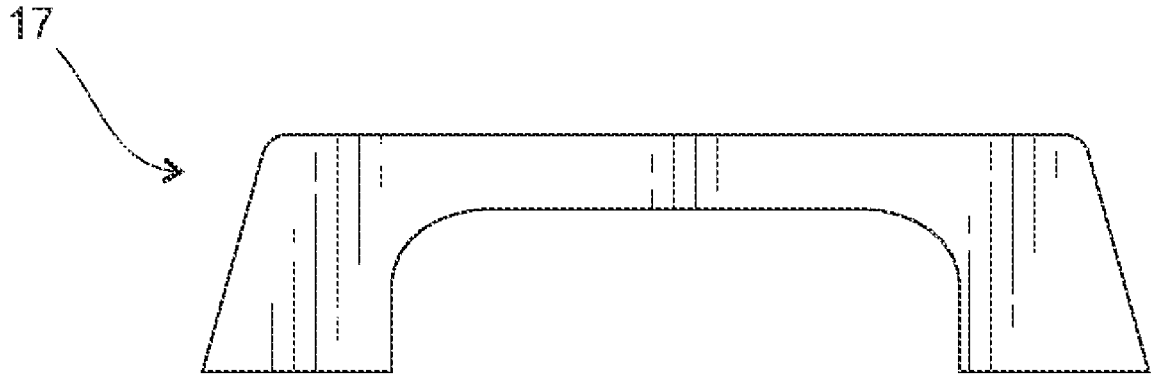
FIG. 5 is a side view of an example handle assembly, which may be attached to the top of a cool cap assembly to assist in installation and removal thereof.
Figure 6:
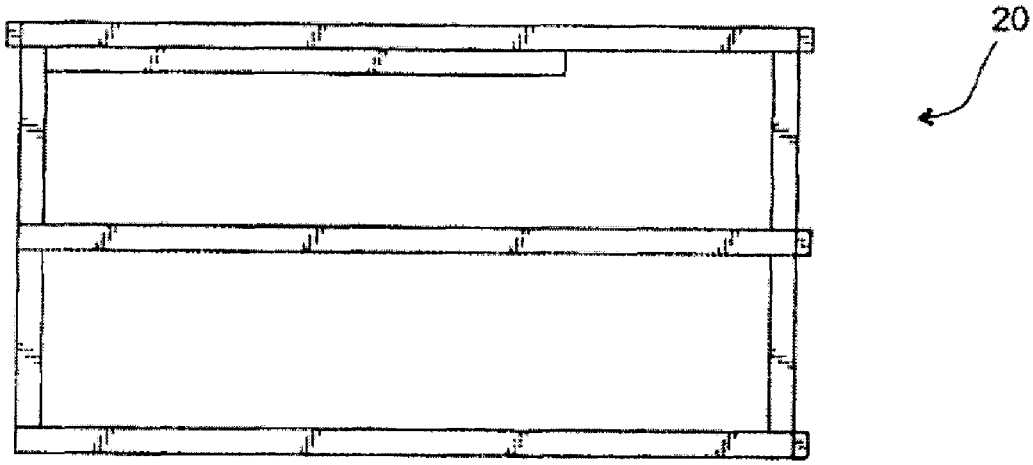
FIGS. 6 and 7 are left and right side views of an internal supporting framework of an example cool cap apparatus.
Figure 7:
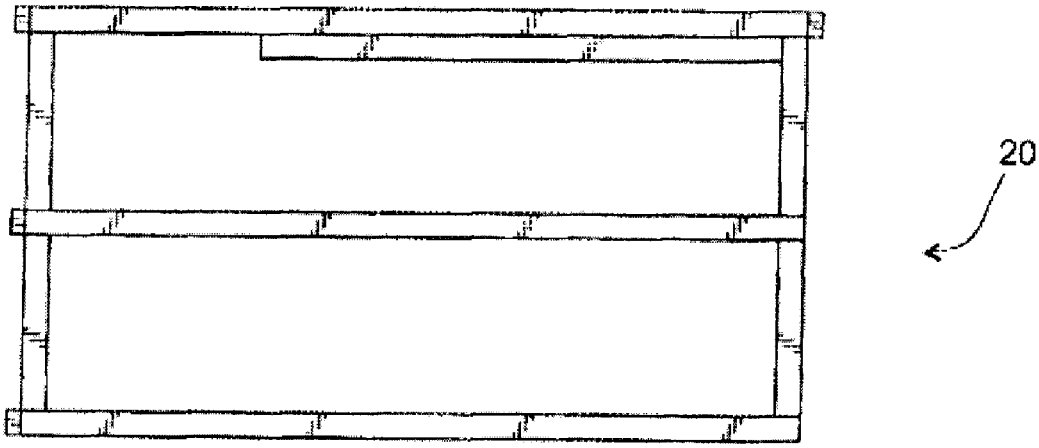

The inventor used FSK brand foil tape on all corners and 3"×3" patches to cover all nail heads. Also, he covered the inside edge of exhaust vent 14. Finally, he cut two 17" lengths from standard 2"×4"×8' timbers to be used for handles 17 as illustrated in FIG. 5.

Still referring to FIGS. 8 and 9, cool cap apparatus 10 included top 12 and surrounding wall members 16, each of which were attached to internal supporting framework 20 (not depicted). Cool cap apparatus 10 is illustrated as having a plurality of surrounding wall members 16, although other configurations are within the scope of the invention. For example, cool cap apparatus 10 could alternatively take the form of a cylinder, in which surrounding wall 16 would be rounded, instead of the rectilinear geometry illustrated in the drawings. Handles 17 are attached to top 12 to facilitate installation and removal of cool cap apparatus 10 from the outdoor heat exchanger 30. Intake opening 18 includes screen 19 to exclude debris (e.g., leaves). Cool cap apparatus 10 may include an additional intake opening 18*a* configured to draw cool air from underneath mobile home 22. During operation, air exits the outdoor heat exchanger from its air outlet vent 34 and then through the exhaust vent 14 of the cool cap apparatus 10.

For improved esthetic appearance, the inventor painted the entire outside of the Dow insulation board along with the two handles using exterior paint selected to complement the color of the surrounding structure. He then attached handles 17 to each side of the unit opening (position over where the pine and PT boards come together and attaching 15" and 32" from the front). Where necessary, he pre-drilled a hole in each end of each handle 17 starting ½" from each end, which put a screw in the center of the location where it attaches to the frame. He then cut the insulation board out where the handles attach and counter sunk the 4" screws by one inch, using Liquid Nails brand adhesive to fill in the holes and around where both handles 17 attach.

The foregoing cool cap apparatus 10 was used as an insulated cap fitting over the top of a heat pump unit including built-in ductwork for air coming to the unit and an opening for air exhausting from the unit. This cool cap apparatus can be used for heat pumps in the cooling mode, air conditioning units in sunlight during the day, and smaller rooftop units for homeowners and small business owners. Although this example embodiment employs rigid foam board and wood, a cool cap apparatus can be alternatively constructed from other materials consistent with the principles discussed herein.

A substantial energy consumption benefit is seen for units that are in the sun for six hours or more hours, which is an estimate is based on measurements made during a trial period. Based on the current cost of materials and the cost of electricity, the payback was estimated to be two years or less based on the inventor's analysis. For example, on a summer day, the temperature in the shade was measured to be 84° F., and in direct sun it was 102° F. The cool cap was not in place, and the heat pump's metal housing temperature was measured to be 119.6° F. The house thermostat was set for 80° F. and the heat pump operated in cooling mode for 15 minutes before any measurements were taken. The air at the vent was measured at 61.8° F. The unit then operated for an additional 30 minutes to satisfy the thermostat. Thereafter, the cool cap was installed and the unit was left to run one whole cycle with the cap on. During the next cycle, the inventor measured the temperature again. The unit ran again for 15 minutes, and the reading at the vent was 49.8° F. The unit in this case only ran for 20 minutes to satisfy the thermostat.

In another example, the inventor measured 140° F. on the metal before cap application, and 58° F. coming from the indoor vent. After cap application, the vent temperature went down to 46° F. One household noticed a $50/month savings on their electric bill. Substantially higher savings are expected for commercial establishments that often pay peak demand electricity rates, which are higher during the daytime when the sun is shining most intensely. Furthermore, commercial establishments often situate outdoor heat exchangers on rooftops where they are exposed to extreme heat conditions because of dark-colored roof pitch or shingles. It is expected that use of a cool cap apparatus on a rooftop outdoor heat pump unit may save $500 or more per year. In addition to consuming less electricity, a cool cap therefore also has a beneficial environmental impact due to reduced need for electricity generation.

While this description is made with reference to exemplary embodiments, it will be understood by those skilled in the art that various changes may be made and equivalents may be substituted for elements thereof without departing from the scope. In addition, many modifications may be made to adapt a particular situation or material to the teachings hereof without departing from the essential scope. Also, in the drawings and the description, there have been disclosed exemplary embodiments and, although specific terms may have been employed, they are unless otherwise stated used in a generic and descriptive sense only and not for purposes of limitation, the scope of the claims therefore not being so limited. Moreover, one skilled in the art will appreciate that certain steps of the methods discussed herein may be sequenced in alternative order or steps may be combined. Therefore, it is intended that the appended claims not be limited to the particular embodiment disclosed herein.

The invention claimed is:

1. An apparatus for use with an outdoor heat exchanger, the heat exchanger having an air inlet vent and an air outlet vent, the apparatus comprising a top having an exhaust vent complementary to the air outlet vent of a heat exchanger; and a surrounding wall attached to the top, wherein the surrounding wall is spaced from the outdoor heat exchanger upon installation, and wherein the surrounding wall has an intake opening having an airflow being equal to or greater than the exhaust vent of the heat exchanger and wherein the surrounding wall forms a substantially unimpeded air pathway through the apparatus, the pathway including through the intake opening, through the air inlet vent of the heat exchanger, through the air outlet vent of the outdoor heat exchanger and out the exhaust vent; wherein the surrounding wall and top are thermally insulating and the top contacts the outdoor heat exchanger.

2. The apparatus according to claim 1, further comprising a supporting framework.

3. The apparatus according to claim 2, wherein the surrounding wall is attached to the top and the supporting framework.

4. The apparatus according to claim 1, wherein the surrounding wall and top comprise a rigid foam material.

5. The apparatus according to claim 1, wherein exterior surfaces of the surrounding wall and top are covered with a light-colored material.

6. The apparatus according to claim 1, wherein the surrounding wall and top are substantially impermeable to air, water, and sunlight, with the exception of the exhaust vent and the intake opening.

7. The apparatus according to claim 1, wherein the outdoor heat exchanger is an air source heat pump.

8. The apparatus according to claim 1, wherein the surrounding wall is spaced between about eight inches and about fifteen inches from the outdoor heat exchanger upon installation.

9. A method of increasing the performance of an outdoor heat exchanger comprising steps of providing an outdoor heat exchanger having an air inlet vent and an air outlet vent;

providing an apparatus comprising a top having an exhaust vent complementary to the air outlet vent; and a surrounding wall attached to the top, wherein the surrounding wall has an intake opening having an airflow being equal to or greater than the exhaust vent and wherein the surrounding wall and top forms a substantially unimpeded air pathway through the apparatus and through the outdoor heat exchanger and out the exhaust vent;

installing the apparatus over the outdoor heat exchanger so that the surrounding wall is spaced from the outdoor heat exchanger and the top contacts the outdoor heat exchanger;

wherein the surrounding wall and top are thermally insulating, and the top and surrounding wall substantially shade the outdoor heat exchanger from direct sunlight.

10. The method according to claim 9, the air pathway is in fluid communication with an air source drawn from a location at a temperature lower than ambient temperature.

11. The method according to claim 10, wherein the location at a temperature lower than ambient temperature is a basement, cellar, or crawlspace under a building.

12. The method according to claim 9, wherein the outdoor heat exchanger is operated at a reduced temperature.

13. The method according to claim 9, wherein the apparatus further comprises a supporting framework.

14. The method according to claim 13, wherein the surrounding wall is attached to the top and the supporting framework.

15. The method according to claim 9, wherein the surrounding wall and top comprise a rigid foam material.

16. The method according to claim 9, wherein exterior surfaces of surrounding wall and top are covered with a light-colored material.

17. The method according to claim 9, wherein the surrounding wall and top are substantially impermeable to air, water, and sunlight, with the exception of the exhaust vent and the intake opening.

18. The method according to claim 9, wherein the outdoor heat exchanger is an air source heat pump.

19. The method according to claim 18, wherein the apparatus is removable and is installed when the air source heat pump is operating in cooling mode.

20. The method according to claim 9, wherein the apparatus is installed prior to or during warm weather conditions.

* * * * *